United States Patent [19]

Wise

[11] Patent Number: 4,648,394

[45] Date of Patent: Mar. 10, 1987

[54] FACEMASK FOR ABRASIVE SERVICE

[75] Inventor: Layton A. Wise, Washington, Pa.

[73] Assignee: Mine Safety Appliances Company, Pittsburgh, Pa.

[21] Appl. No.: 743,785

[22] Filed: Jun. 12, 1985

[51] Int. Cl.[4] ..... A62B 7/00

[52] U.S. Cl. ..... 128/201.24; 2/434; 2/429; 351/154; 351/47; 350/257

[58] Field of Search ..... 128/201.12, 201.14, 128/201.15, 206.23, 201.22, 201.23, 201.24, 201.25; 2/15, 8, 427, 429, 431, 434, 441; 296/93; 351/154, 47; 350/245, 252, 257; 248/309.1, 312.1

[56] References Cited

U.S. PATENT DOCUMENTS

| | | | |
|---|---|---|---|
| 2,152,383 | 3/1939 | Leader | 2/8 |
| 2,365,779 | 12/1944 | Schwab | 128/201.14 |
| 2,384,798 | 9/1945 | Conway | 2/8 |
| 3,147,487 | 9/1964 | Hoeftman | 2/427 |
| 3,440,661 | 4/1969 | Newcomb | 2/434 |
| 3,577,563 | 5/1971 | Raschke | 2/8 |
| 3,659,896 | 5/1972 | Smith et al. | 296/93 |
| 4,076,373 | 2/1978 | Moretti | 2/434 |
| 4,455,687 | 6/1984 | Johansson | 2/434 |
| 4,563,065 | 1/1986 | Kreissl | 351/47 |

*Primary Examiner*—Henry J. Recla

*Attorney, Agent, or Firm*—Reed Smith Shaw & McClay

[57] ABSTRACT

A viewing assembly for use in the lens opening of a protective facemask comprising: a transparent housing adaptor sealingly mated to the lens: a substantially rectangular retainer for a lens cartridge assembly comprising opposing planar panels and providing in the latched position a recess that sealingly retains an enclosed lens cartridge assembly; an open area in each of said planar surfaces providing a common portal for viewing through the holder body; a lens cartridge holder defining a first open frame portion the outer periphery of the assembly being adapted to sealingly engage the inner surface of the holder adaptor; a first transparent lens positioned within said housing and abutting the assembly flange and positioned so as to provide sealing contact therewith; at least one other similarly configured lens adapted to adjoin the first lens yet being removable therefrom by manual manipulation; and at least one flexible strip secured to each of the removable lenses and at its other extremity being of a sufficient length to permit manual grasping, thereby serving to permit removal of a lens from its peripheral retention by said lens holder.

5 Claims, 6 Drawing Figures

FACEMASK FOR ABRASIVE SERVICE

This invention relates to a face protective mask with a respirator employed in heavy duty industrial uses, and in particular to a new durable sealed viewing lens cartridge assembly.

BACKGROUND OF THE INVENTION

In many industrial activities, workers require full facemasks mounted in hoods which rely on a separate air supply for respiration for protection. Many of these workers also require a full field vision to carry out their work effectively. Typical applications are with spray painters (deleterious solvents employed), welders (gas fuel and eyeburn risks from arc filtering) and surface blasters (sanders), who prepare corroded surfaces for recoating, painting, and the like.

In applications such as jet blasting, workman require both physical and respiratory protection from the particulate sanding material and loosened scale. The typical protective mask with its air intake passages and the outer viewing facepiece become clogged and obstructed. Practical operation requires that the pitted viewing lens be replaced with a new lens while working in the contaminated atmosphere. Protective upper body hoods, whether waist or shoulder length, are available to accomodate facemasks and their integrated breathing tubes and exhalation equipment.

One of the problems encountered in use of these protective masks is the difficulty in replacing the lens retainment under field conditions. Other problems include the inability to obtain a good seal to minimize grit ingestion and keeping the lens in place during use.

It is, therefore, an object of the invention to provide a lens and cartridge assembly for use with a standard protective facemask and associated abrasive blast hoods. It is another object to provide a lens cartridge assembly which can be replaced with a different configuration of lenses in the facepiece component with considerable ease when the existing unit has reached its limits of usefulness or specific service. It is still another object to provide a novel lens assembly which provides superior sealing against the invasion of grit from the outside into the breathing components of the external protective assembly.

SUMMARY OF THE INVENTION

Generally, the present invention provides a lens cartridge assembly which can be readily mated with any one of a variety of lens housing adaptors. These adaptors are tailored for specific field uses. The lens cartridge of the present invention is sealably mounted on the face opening of a head or facemask. The lens of the cartridge assembly can be substituted or exchanged to accommodate the particular work environment, such as sand blasting, welding, or the like. With the invention, the chance for grit being forced between the lens assembly and its surrounding adaptor is minimized. Also, when grit infiltration does occur, the lens assembly is handily removed, the lenses refurbished, or replaced for another type of service, and then quickly restored to the facepiece housing adaptor.

The present invention is particularly well adapted for use with a facemask having means for respiration, including a head buckle assembly, a mask exhalation valve, and an inhalation tube assembly. These masks also have a sealable but transparent front facepiece, a lens opening to receive a viewing lens, lens ring, and a lens housing adaptor operatively connected to the facepiece for viewing. The lens holder itself is of a generally rectangular shaped configuration thereby facilitating full field vision. It is preferably molded of any one of a variety of thermoplastic materials, which are known as castable (moldable) resins, have high elastic modulus and good electrical resistance. Rigid or flexible thermoplastics can be used depending on the environmental conditions. Flexible polyurethane foams are well suited to the present invention, since they can be fabricated to a formed configuration but are deformable with minimal pressure by the lenses, yet have memory which returns them to their initial fabricated configuration upon lens removal.

The present invention also provides a retainer element adapted to releasably support the lens assembly comprising a first rigid planar panel with a substantial opening in its face that defines a first open frame portion, a similarly configured and spaced apart second planar panel, means to provide a hingeable mating along one edge of the aligned panels and means to permit interruptable latching of the panels. The retainer facilitates the removal and replacement of lens cartridges. Other advantages of the invention will become apparent from a perusal of the following detailed descriptions taken in connection with the accompanying drawings.

DETAILED DESCRIPTION

Figure 1:
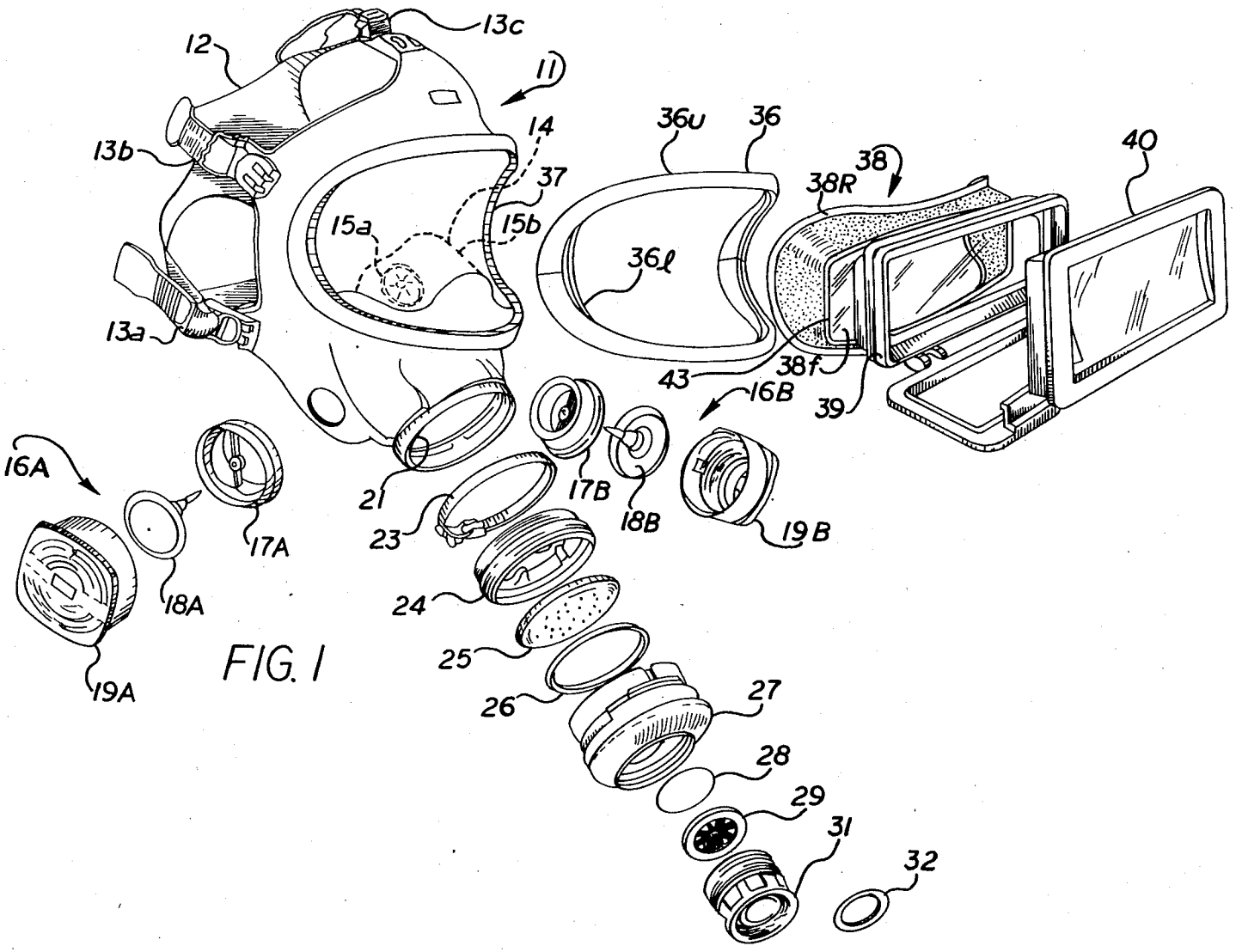
FIG. 1 is an exploded, perspective view of the major components of a mask, lens, facepiece and eyes protective lens assembly, including the multi-lens assembly cartridge of the present invention.

Referring to FIG. 1, a conventional face protective mask facepiece 11 is shown, with respiration accessories and provision for wearer viewing in an industrial setting. A harness 12 is tensioned against the back of the head (not seen) by the use of buckle assemblies 13*a*, 13*b* and 13*c*. A nose cup assembly 14 is dispose within the mask to rest sealingly on the wearer's nose bridge. Cup 14 has bilateral valve spiders 15*a* and 15*b*. In the lower section of flexible mask 11 are laterally opposing exhalation valve assemblies 16*a* and 16*b*, and consisting of a fitted valve body 17*a* and 17*b*, a flapper valve 18*a* and 18*b*, and the externally facing valve cover 19*a* and 19*b*, respectively.

Figure 2:
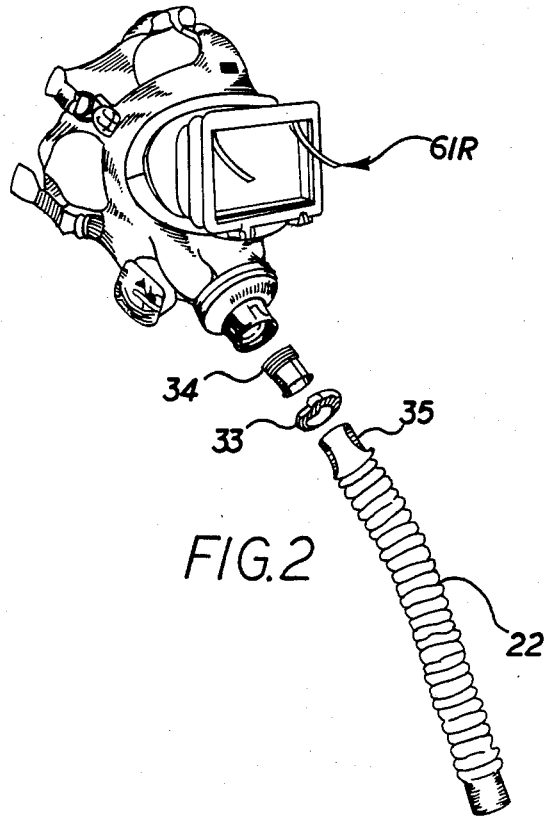
FIG. 2 shows the assembly in perspective of FIG. 1 in an operating mode with a breathing tube.

Centrally located in the lower section of the mask is mask port 21 which accomodates breathing tube 22 (shown in FIG. 2). Positioned between port 21 and tube 22 for securing them together are clamp 23, retainer ring 24, speaking diaphram 25, O ring 26, inlet housing 27, disk valve 28, combined gasket and valve spider 29, tube adapter assembly 31 and gasket 32. Clamp 33 and threaded insert 34 (shown in FIG. 2) which slips over tube rigid end 35 serve to couple breathing tube 22 to mask port 21.

With respect to the support of protective lenses assembly there is provided a generally concave ring 36 deferring lens frames 36*u* and 36*l*, which serve as a peripheral ring that slips over the ovular channeled opening 37 centrally located on the front of mask 11. Faceplate lens adapter 38 includes a narrow peripheral edge or rim 38R which is adapted to engage channeled opening 37 and is secured therein by half-rings 36*u* and 36*l*, as is shown in U.S. Pat. No. 3,968,793, which is incorporated herein by reference. Lens adapter 38 is preferably made of a plastic, such as from a polycarbonate resin. Lens adapter 38 includes a planar lens face 38F which is transparent. Positioned adjacent to and matable therewith is to hinged, preferably bottom-hinged, lens assembly retainer 39 which will be described in connection with FIGS. 3 and 4.

Figure 5:
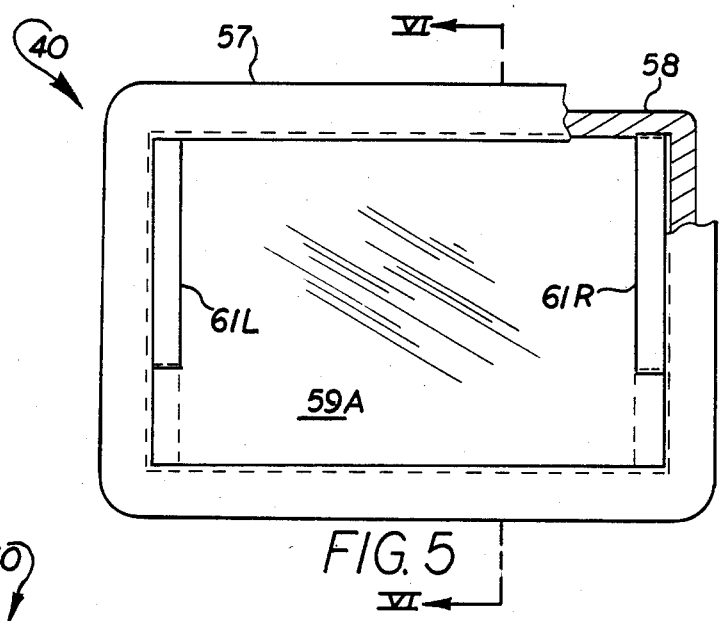
FIG. 5 is a front elevational, in partial section, of the novel lens assembly and holder ready for mounting on the housing adaptor assembly of FIG. 3.
Figure 6:
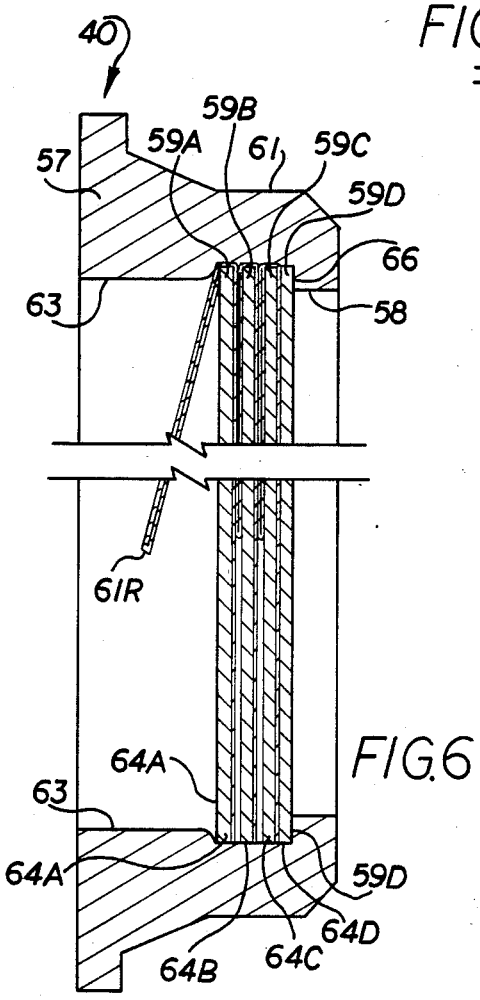
FIG. 6 is a side elevational view, in full section, of the multi-lens cartridge assembly of the invention, taken along line VI—VI of FIG. 5.

Positionable within retainer 39, is the lens cartridge assembly 40 of the present invention to be described in detail in relation to FIGS. 5 and 6. Faceplate lens adaptor 38 is preferably used on masks by persons engaged in abrasive blasting operations. The severity of the blasting operation is compensated for by the specific choice of multi-lens assemblies, variable numbers of lenses, thicknesses and tempering which are possible to employ.

Lens adaptor 38 includes a first narrow peripheral edge or Rim 38R which is adapted to engage channeled half-rings 36*u* and 36*l*. The reverse side of ring 36 is also channeled (not seen) and is adapted to mate with frame 37 of the mask opening, for example, as shown in U.S. Pat. No. 3,968,793, which is incorporated herein by reference. Lens adapter 38 is preferably made of a plastic, such as from a polycarbonate resin. Lens adapter 38 includes a planar lens face 38F which is transparent.

Figure 3:
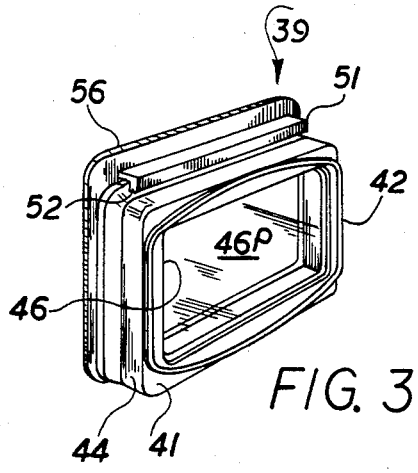
FIG. 3 is a perspective view of the reverse side of holder 39 shown in FIG. 1.

Cartridge retainer 39 is provided with an open frame 46 in face plate 41, as is best seen in FIG. 3. The edge of plate 41 is further provided with a flange 42 that mates with shoulder 43 of lens adapter 38. Cartridge retainer 39 is mounted, preferably by sonic bonding or by adhesive, to lens adapter 38 and is configured to receive lens cartridge 40. Lens adapter 38 has a flared bilateral configuration, of which its Rim 38R peripherally engages with channeled ring 36, as described above.

Figure 4:
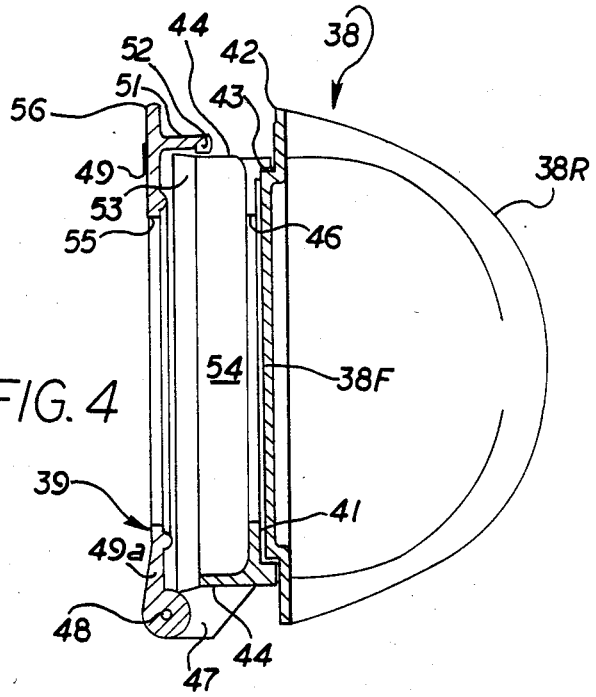
FIG. 4 is a side plan view, in full section of the housing adaptor assembly tailored for use in abrasion blasting of surfaces and adapted to receive the lens cartridge assembly of the present invention.

In FIG. 4, lens adaptor 38 has its opposing planar face 38*f*, which is stepped downward near its periphery, provided with raised shoulder 43 that receives and locks with the flanged outwardly, ringlike, ridge 42 of retainer 39. The inner surface of face panel 41 has a substantially rectangular cut out 46 to create a vision path 46*p* through the body of the housing. The lowest point of the circumference of frame edge 44 is provided with at least one a radially disposed rib 47 which has an axial passage (not seen) serving to permit the rib to be hinged by a metal pin 48 to the outwardly hinged, frame face 49*a* which is also provided with an axial passage (not seen).

Front panel 49 of frame 44 is provided with an inwardly facing horizontal strip 51, which is preferably pliable, having a downwardly depending bead 52 that overlaps the outwardly flanged upper detent 53 of frame 44. A rectangular recess 54 is defined by panel 49, frame 44 and adaptor face 38*f*, which serves to receive lens assembly 40. Rectangular opening 55 in panel 49 is of a substantially identical dimension to that of opening 46 of plate 41. When a lens cartridge assembly 40 is to be installed (not seen in FIG. 3), the bead latch 52 can be released by a minimum effort exerted at upper edge of frame 44 to access the lens assembly chamber 54, and thus to replace a marred or gritted assembly 39. Vertical flange 56 extends above frame edge 44 and is contiguous with panel 49.

Referring to FIG. 5, a front view (as loaded into retainer 39) of cartridge lens assembly 40 is shown, comprising cartridge frame 57, preferably made from an elastomeric material. Cartridge frame 57 includes a supporting shoulder 58 shown (shows broken out portion), for supporting the peripheral edges of the most outwardly positioned, removable lens 59A. The lenses have a pair of oppositely positioned end tapes 61L and 61R facilitating removal of the individual lenses. Each of such lenses are of a preferably rectangular shape configuration and so oriented with their longer edges being horizontal, providing maximum peripheral vision for the user.

With a reference to FIG. 6, lens cartridge frame 57 is preferably molded from a deformable elastomeric material, such as flexible polyurethane foam. The outer periphery 61 of assembly 40 is adapted to snugly engage the inner chamber 54 of retainer 39. The inner periphery 63 is sized to sealingly engage the edges 64A through 64D of a plurality of lenses 59A to 59D to provide a dust-free seal.

Supporting shoulder 58 (abutting innermost lens 59D) of holder 40 is flanged inwardly to provide a sealable shoulder 66 to support the periphery of innermost lens 59D when it is placed in snug abutment thereto. Transparent lens 59D is positioned within frame 57 of cartridge 40, and sealed, edge-wise, by surface 63, asurface 66. Abutting first lens plate 59D are a plurality of lenses, 59A–59C, sized to engage their edges 64A through 64C in a airtight seal, with the inner periphery 63 of the deformable cartridge 40. Lense 59 may be made from glass or other transparent material. The selection of material is based upon the intended operating environment.

The replaceable lenses are removable by manual manipulation which is preferably facilitated by using one or more flexible strips, 61L and 61R (FIG. 5). These strips are preferably bonded along one extremity of the strip to the surfaces of each of the removable glass lenses. The other free end of the strip extends outwardly (while retained within cartridge 40) but its of a sufficient length to permit manual grasping to serve for removal of its attached single lens from its compressive peripheral retention (and the vacuum between lens surfaces) by the holder inner surface 63. The strips are made quite thin so as to cause only minimal spacing apart of the adjacent lenses when they are aligned for use. In the preferred embodiment, the innermost lens 59D is adhesively bonded on its periphery to the abutting holder flange 66. Also preferably, the two strips, such as 61L and 61R, are bonded to each of the removable lens 59A, 59B and 59C. They are conveniently positioned on the vertical periphery of each lens so as to minimize any visual distortion.

An assembly of lenses as shown in FIG. 6 are prepackaged in varying dimensions and uses, and containerized to be ordered as needed for a particular service, such as those described above.

In another embodiment, removable lens 59A and 59B are laminated to one another where stress forces are anticipated. Alternatively, the removable lenses 59A to 59C may be of tempered or untempered glass, and may vary from two that are laminated to four which are merely arranged face to face to form the lens package.

While in the foregoing, preferred embodiments of the invention has been described, it should be understood to one skilled in the art that various modifications and changes can be made without departing from the true spirit and scope of the invention as recited in the appended claims.

I claim:

1. A viewing assembly for use in the lens opening of a protective facemask having a viewing portal sealed from the outside atmosphere by a lens that covers said portal, comprising:

a. a lens cartridge assembly molded from a resilient elastomeric material, and defining a first open substantially rectangular frame portion having outer and inner peripheral surfaces, at least two precut lenses having peripheral edges sealingly engaged with said inner peripheral surface, said inner surface of the assembly being flanged inwardly forming a margin which provides a retaining wall for the periphery of the first of said lenses when it is placed in abutment thereto;

b. said first transparent lens positioned within said assembly and abutting said flange and positioned so as to provide sealing contact therewith;

c. said at least one other similarly configured lens positioned adjacent the first lens and being sealingly engaged at its edges to the inner surface on the assembly frame and yet being removable therefrom by manual manipulation;

d. at least one flexible strip secured at one end to each of the removable lenses and at its other extremity being of a sufficient length to permit manual grasping, thereby serving to permit removal of a lens from its peripheral retention by said lens frame;

e. a transparent housing adaptor adapted to be sealingly mated to said lens and including a substantially rectangular retainer for receiving said lens cartridge assembly and consisting essentially of two opposing planar panels hinged together along one longitudinal dimension of each panel and having latch means for holding said panels in a latched position in which said panels define a rectangular shaped recess complemental to the outer peripheral surface of said lens cartridge assembly, said assembly being secured in said recess; and f. one of said panels adapted to be sealingly mated with said lens and an open area in each of said planar panels which are substantially aligned, when in said latched position, providing a common portal for viewing therethrough.

2. The assembly retainer of claim 1 wherein said latch means comprises a protruding continuous ridge on on said one of said panels which is adapted to detachably engage an adjacent stepped surface on the other of said panels.

3. A protective face mask adapted for use with a respirator comprising:

(a) a mask body adapted to cover a face of a user and having a viewing portal with a permanent lens sealingly mounted in and covering said viewing portal;

(b) a lens cartridge retainer having a pair of overlapping adjacent panels one of which is sealingly secured to said lens, said panels provided with a single hinged connection therebetween along one of their peripheral edges and defining, when in their overlapping positions, inner surfaces providing an inner chamber, said other of said panels adapted for manual release to provide access from outside of the mask to said chamber defined by said retainer and, (c) a lens cartridge assembly complementally configured to said chamber and removably disposed therein, said cartridge comprising (i) on open deformable frame made of a resilient elastomeric material with the outer periphery of the frame complementally configured to sealingly engage the inner surfaces of the chamber, said frame also defining an inner peripheral surface;

(ii) at least two disposable lenses positioned so that the planar faces of the lens are layered one upon the other and secured in said frame around the outer peripheral edges of the lenses to the inner peripheral surface of the frame and which disposable lenses can be removed only from outside of the mask; and (iii) further wherein, each of said disposable lenses has at least one end tape bonded to the planar surface of each disposable lens where said planar surface faces outward from the face of the user so that the user may grasp the end tape from outside of the mask to facilitate removal of the lens.

4. The cartridge assembly of claim 3 wherein said inner surface of the frame is flanged inwardly forming a planar margin which further provides a retaining shoulder for the peripheral edge of the lens which is placed in abutment thereto.

5. The assembly retainer of claim 1, wherein said lens includes a substantially rectangular shaped shoulder extending outwardly therefrom and said one of said panels includes a rearwardly extending flange engaging said shoulder to sealingly mate said one of said panels to said lens.

* * * * *

UNITED STATES PATENT AND TRADEMARK OFFICE

CERTIFICATE OF CORRECTION

PATENT NO. : 4,648,394

DATED : March 10, 1987

INVENTOR(S) : Layton A. Wise

It is certified that error appears in the above-identified patent and that said Letters Patent is hereby corrected as shown below:

Column 4, line 35, after "63", "asurface" should read -- and shoulder --.

Column 6, line 22, after "cartridge" insert -- assembly --.

Column 6, line 23, after "(i)", "on" should read -- an --.

Signed and Sealed this

Twenty-second Day of December, 1987

*Attest:*

DONALD J. QUIGG

*Attesting Officer*

*Commissioner of Patents and Trademarks*